US010300585B2

(12) United States Patent
Da Fonseca

(10) Patent No.: US 10,300,585 B2
(45) Date of Patent: May 28, 2019

(54) RATCHET TYPE POWER WRENCH

(71) Applicant: ATLAS COPCO INDUSTRIAL TECHNIQUE AB, Stockholm (SE)

(72) Inventor: Cesar Da Fonseca, Ecouflant (FR)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 104 days.

(21) Appl. No.: 15/553,992

(22) PCT Filed: Feb. 25, 2016

(86) PCT No.: PCT/EP2016/054018
§ 371 (c)(1),
(2) Date: Aug. 26, 2017

(87) PCT Pub. No.: WO2016/135261
PCT Pub. Date: Sep. 1, 2016

(65) Prior Publication Data

US 2018/0043513 A1 Feb. 15, 2018

(30) Foreign Application Priority Data

Feb. 27, 2015 (EP) ..... 15305310.3

(51) Int. Cl.
*B25B 21/00* (2006.01)
*B25B 23/145* (2006.01)

(52) U.S. Cl.
CPC ..... *B25B 21/005* (2013.01); *B25B 23/1456* (2013.01)

(58) Field of Classification Search
CPC . B25B 21/005; B25B 23/1456; B25B 21/004; B25B 23/0078; B25B 13/463; B25B 21/002
See application file for complete search history.

(56) References Cited

U.S. PATENT DOCUMENTS 4,200,011 A 4/1980 Wilmeth
4,339,968 A 7/1982 Krieger
(Continued)

FOREIGN PATENT DOCUMENTS

EP 2113341 A2 11/2009

OTHER PUBLICATIONS

International Search Report (ISR) and Written Opinion dated May 23, 2016 issued in International Application No. PCT/EP2016/054018.

*Primary Examiner* — Robert J Scruggs
(74) *Attorney, Agent, or Firm* — Holtz, Holtz & Volek PC

(57) ABSTRACT

A ratchet type power wrench includes a housing, a pressure medium powered actuator, a ratchet mechanism included in the housing and coupled to the actuator, an open ended output socket with a constant cross sectional dimension throughout a length thereof, which is rotatably supported in the housing and engaged by the ratchet mechanism, and an angle encoder provided to indicate angular displacements of the output socket. The angle encoder has a form of a separate unit included in a casing, the casing being attachable to either side of the housing for connecting the angle encoder to either end of the output socket. The angle encoder includes a rotatable signal initiating part and a movement sensor rigidly mounted in the casing, the rotatable signal initiating part being provided with at least one coupling dog adapted to engage cavities located at both ends of the output socket.

2 Claims, 2 Drawing Sheets

(56) References Cited

U.S. PATENT DOCUMENTS 4,845,998 A * 7/1989 DeMartelaere ..... B25B 23/14
73/862.23
6,965,835 B2 * 11/2005 McGee ..... B25B 23/14
702/151

* cited by examiner

RATCHET TYPE POWER WRENCH

TECHNICAL FIELD

The invention relates to a power wrench including a ratchet mechanism for step-wise tightening of screw joints. In this type of power wrench an output socket for connection to a screw joint is intermittently rotated by a pressure medium powered actuator coupled to the ratchet mechanism, wherein the actuator is powered by a pulsating pressure from a pressure medium source to perform repeated power strokes.

BACKGROUND

This type of power wrench is previously well known and described in for instance European Patent No. 2 113 341. The ratchet type power wench described in this publication is provided with both a torque sensor and a rotational movement indicating angle encoder for retrieving data concerning a performed tightening operation to thereby enable approval or disapproval of the quality of a performed tightening operation. The torque sensor comprises a torsion load sensing strain gauge arrangement provided inside the output socket of the wrench, whereas the angle encoder comprises a code disc carried on a closed rear end portion of the output socket.

A problem concerned with the above described power wrench is that the output socket comprises a closed end portion specifically designed to carry the code disc of the angle encoder. Also the torque sensor arrangement requires a certain design of the output socket. This means in turn that the output socket could not be used as an open ended socket connectable to a screw joint or a screw joint engaging implement in alternative ways, for example to tighten right or left hand threaded screw joints or loosen previously tightened screw joints. This is a serious drawback since this type of wrench is rotated in one direction only. It would be possible, however, to remove the torque sensor arrangement from the output socket and use the pressure of the pressure medium fed to the actuator as a measure for the delivered output torque, but still the angle encoder arrangement makes it impossible to use the output socket for alternative ways of screw joint engagement and rotation.

Moreover, the closed end portion of the output socket carrying the code disc forms a limitation for the length of a protruding end portion of a screw when an engaging nut is run down and tightened on said screw by the power wrench.

SHORT DESCRIPTION OF THE INVENTION

It is an object of the invention to avoid the above mentioned problems by providing a ratchet type power wrench with an angle encoder, which power wrench is adaptable to alternative types of joints.

The invention relates to a ratchet type power wrench comprising a housing, a ratchet mechanism supported in the housing, a pressure medium powered actuator coupled to the ratchet mechanism, a rotatable output socket connected to the ratchet mechanism and connectable to a screw joint, and an angle encoder provided to indicate angular displacements of the output socket. The output socket is open ended for alternative ways of engagement with a screw joint, and the angle encoder comprises a rotatable signal initiating part detachably connected to either end of the output socket.

According to a specific embodiment of the invention the angle encoder has the form of a separate angle encoder unit including said rotatable signal initiating part, said angle encoder unit being attachable to either side of the housing for enabling connection of said rotatable signal initiating part to either end of the output socket.

In another embodiment of the invention the angle encoder unit comprises a casing supporting a movement sensor, wherein said rotatable signal initiating part comprises an annular code ring which is intended to cooperate with said movement sensor.

In yet another embodiment of the invention the casing is configured so as to be attached to either side of the housing, and said rotatable signal initiating part is provided with one or more coupling dogs for cooperating with cavities provided at both ends of the output socket.

Further objects and advantages of the invention will appear from the drawings and the following specification.

SHORT DESCRIPTION OF THE DRAWINGS

A preferred embodiment of the invention is described below with reference to the accompanying drawings, in which.

DETAILED DESCRIPTION OF THE SHOWN EMBODIMENT

The type of power wrench to which the invention is related comprises a ratchet mechanism with an output socket to be connected to a screw joint, a pressure medium powered actuator coupled to the ratchet mechanism, and a pressure medium delivering device connected to the actuator for a pulsating activation of the ratchet mechanism. Since the actuator and the pressure medium delivering device, preferably a hydraulic pump with a control unit, are well known in prior art and do not form any part of the invention they are left out of this specification. So are the details of the ratchet mechanism.

The power wrench according to the invention is provided with a torque indicating means in the form of a non-illustrated pressure sensing device employed in the pressure medium circuit connected to the wrench. The pressure of the medium delivered to the wrench actuator corresponds directly to the activation force of the actuator and the output torque of the wrench. This means that no torque transducer is provided in the ratchet mechanism or on the output socket.

Figure 1:
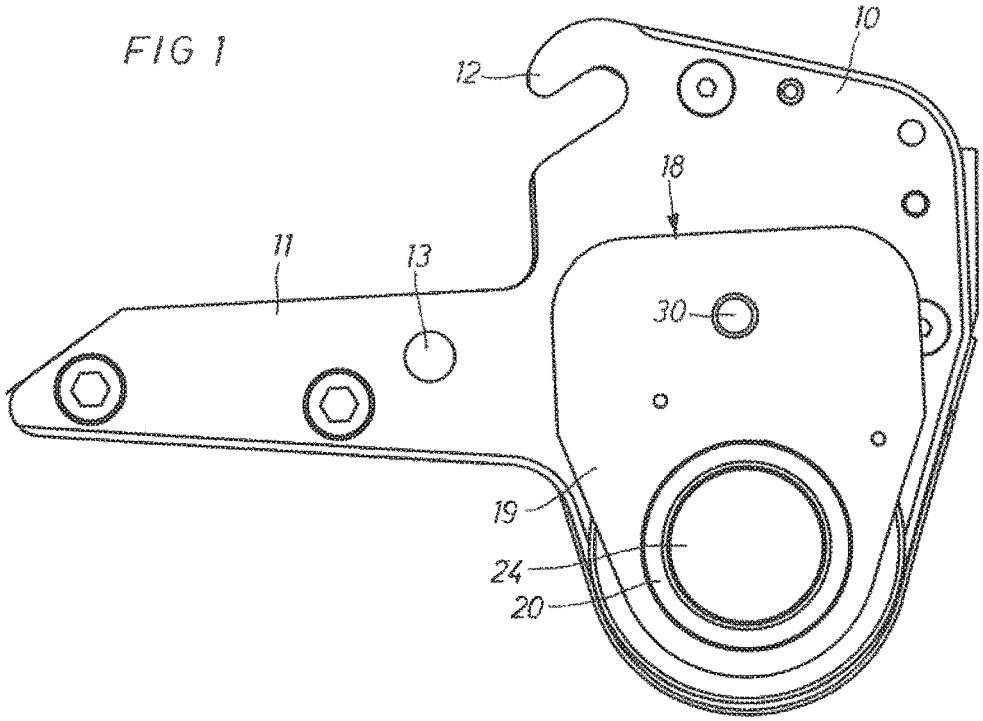
FIG. 1 is a side view of power wrench according to the invention without an actuator mounted.

The power tool illustrated in the drawings comprises a ratchet mechanism supported in a housing 10. As is apparent in FIG. 1 the housing 10 is formed with a support arm 11 and a hook like fixation portion 12 for connection of a non-illustrated piston-cylinder type actuator to the ratchet mechanism. The support arm 11 has a transverse hole 13 for receiving a bolt for locking the actuator to the housing 10.

Figure 2:
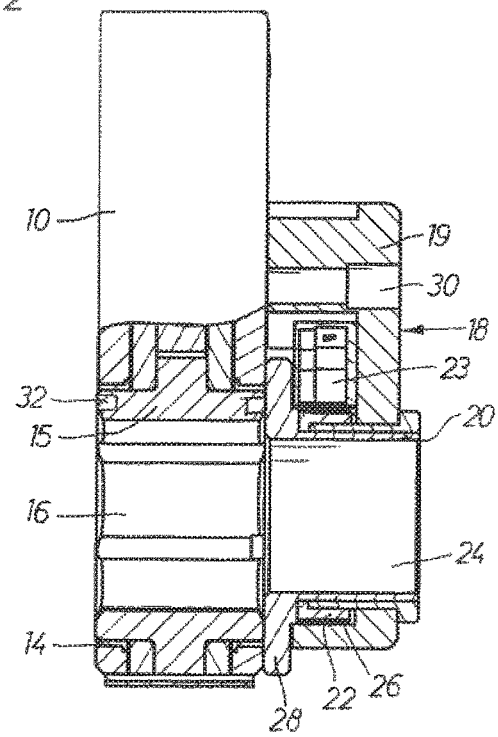
FIG. 2 shows a vertical cross section through a part the power wrench in FIG. 1.
Figure 3:
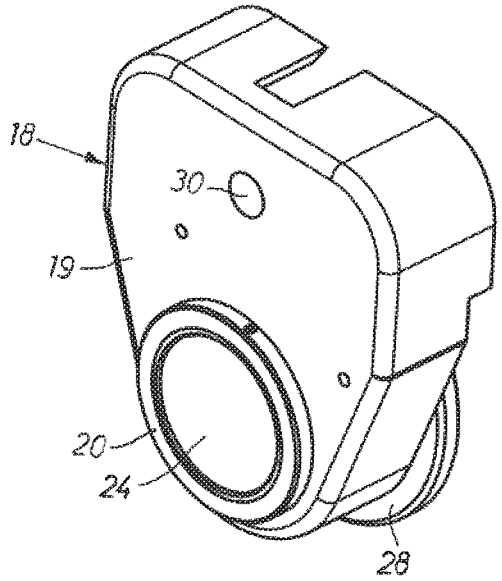
FIG. 3 is a perspective view of the angle encoder unit.
Figure 4:
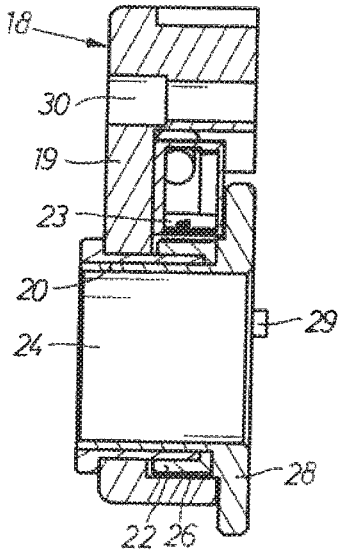
FIG. 4 shows a vertical section through the angle encoder unit.

As shown in FIG. 2 the housing 10 has a transverse opening 14 in its lower part for supporting a rotatable tubular output socket 15 by which the wrench is to be connected to a screw joint or a screw joint engaging implement.

The ratchet mechanism and the actuator are of conventional designs well known in the art and are not described in further detail. The output socket 15 is open ended, i.e. having a through opening 16 of a constant cross sectional dimension throughout its length, which means that it may be connected to a screw joint or a screw joint engaging implement from either side. This is an important feature since this type of power wrench has only one direction of rotation, and by enabling application on screw joints from either side it is possible not only to tighten right hand threaded joints as well as left hand threaded joints but also to loosen previously tightened screw joints.

As being described in further detail below an angle encoder unit 18 is attached to the housing 10. The purpose of the angle encoder is to provide an indication of the angular displacements of the output socket 15 during tightening operations, wherein the indicated angular displacement of the output socket 15 in combination with the measured torque indicating pressure levels of the pressure medium are compared with predetermined limit values for evaluating the quality of performed tightening operations. This is obtained in a process control unit provided in the pressure medium circuit.

As illustrated in FIG. 2, the angle encoder unit 18 comprises a casing 19, a rotatable signal initiating part in the form of a code ring 22, a support sleeve 20 carrying the code ring 22, and a movement sensor 23 rigidly mounted in the casing 19 in a close but spaced relationship relative to the code ring 22. The code ring 22 has a cylindrical circumferential surface 26 which comprises a material suitable to be magnetized, wherein narrow axially directed magnetic bands are provided at an even pitch along the circumferential surface 26 and intended to intermittently activate the sensor 23 at rotation of the code ring 22. Thereby, the movement sensor 23 will emit pulsed signals in response to the angular displacement of the code ring 22 in its co-rotation with the support sleeve 20 and the output socket 15.

An accumulated number of signal pulses will represent the total angular displacement of the output socket 15 during a tightening process, and the relationship between this total angular displacement and the final torque value provide indications of how the tightening process proceeds. A post-tightening treatment of the signals representing the totally obtained angular displacement of the output socket 15 and the final torque value is performed by a non-illustrated process control unit, and the result is compared to predetermined limit values so as to enable evaluation of the quality of the performed tightening operation.

The support sleeve 20 has a through opening 24 of a cross sectional dimension about equal to the through opening of the output socket 15, which means that there is no limitation of the length of any protruding end portion of a screw joint being tightened.

The housing 10 and the angle encoder unit 18 are adapted to be assembled in two different ways, namely with the angle encoder unit 18 attached to either side of the housing 10. Since the housing 10 as well as the output socket 15 are symmetric in shape it is possible to mount the angle encoder unit 18 on that side of the housing 10 that is favorable for a certain screw joint tightening or loosening operation. In its alternative positions on the housing 10 the angle encoder casing 19 is located with the support sleeve 20 in line with the output socket 15, wherein the support sleeve 20 is formed with a drive flange 28 which is provided with coupling studs 29 to engage bores 32 in the end surfaces of the output socket 15.

A bore 30 extends through the casing 19 to be penetrated by a mounting screw which is intended to engage a threaded hole in the housing 10 to fix and lock the angle encoder unit 18 to the housing 10. As to what is required by the actual tightening or loosening power wrench operation the angle encoder unit 18 is mounted on that side of the housing 10 that is remote from the screw joint to be worked such that the output socket 15 gets as close as possible to the screw joint and being able to fully enclose a nut or screw head for a proper torque transfer thereto. Shifting sides of the angle encoder unit 18 on the housing 10 is an easy task in that you only have to remove the mounting screw extending through the bore 30 and lift off the angle encoder unit 18, relocate it to the opposite side of the housing 10 and refit and tighten the mounting screw. Due to non-illustrated studs the casing 19 will get into a correct position on the housing 10 with the support sleeve 20 in a correct coaxial position relative to the output socket 15. It is essential, however, to make sure that the drive studs 29 on drive flange 28 of the support sleeve 20 get into a proper engagement with the bores 32 in the output socket 15.

By combining a symmetrically shaped ratchet wrench housing 10 and an open ended symmetric output socket 15 with a separate angle encoder unit 18 it is possible to readily adapt the ratchet wrench to different operation situations and requirements and still be able to obtain actual operation data relating to angular displacement and delivered torque values for quality evaluation of performed tightening operations.

The above described advantages are obtained by the invention as it is defined in the claims. The embodiments of the invention, however, are not limited to the above described example but may be freely varied within the scope of the claims. For instance, the code ring 22 may be of a different design. Instead of being provided with magnetized bands it may be formed with a circumferential row of axially directed grooves or slots to cooperate with a suitable sensor to emit rotation responsive signals.

The invention claimed is:

1. A ratchet type power wrench comprising:

a housing;

a pressure medium powered actuator;

a ratchet mechanism comprised in the housing and coupled to the actuator;

an open ended output socket with a constant cross sectional dimension throughout a length thereof, which is rotatably supported in the housing and engaged by the ratchet mechanism; and an angle encoder provided to indicate angular displacements of the output socket, wherein the angle encoder:

has a form of a separate unit comprised in a casing, the casing being attachable to either side of the housing for connecting the angle encoder to either end of the output socket, and comprises a rotatable signal initiating part and a movement sensor rigidly mounted in the casing, the rotatable signal initiating part being provided with at least one coupling dog adapted to engage cavities located at both ends of the output socket.

2. The ratchet type power wrench of claim 1, wherein the rotatable signal initiating part comprises an open ended support sleeve and an annular code ring, wherein the support sleeve is formed with a drive flange carrying the at least one coupling dog.

* * * * *